US006208303B1

(12) United States Patent
Tachihara et al.

(10) Patent No.: US 6,208,303 B1
(45) Date of Patent: Mar. 27, 2001

(54) WINDOW GLASS ANTENNA APPARATUS FOR VEHICLES

(75) Inventors: Hiroyuki Tachihara, Inzai (JP); Mahmood Ahrabian, Novi, MI (US)

(73) Assignee: Harada Industry Co., Ltd. (JP)

( * ) Notice: Subject to any disclaimer, the term of this patent is extended or adjusted under 35 U.S.C. 154(b) by 0 days.

(21) Appl. No.: 09/502,449

(22) Filed: Feb. 11, 2000

(30) Foreign Application Priority Data

Feb. 18, 1999 (JP) ..... 11-040133

(51) Int. Cl.[7] ..... H01Q 1/32; H01Q 1/02
(52) U.S. Cl. ..... 343/704; 343/713
(58) Field of Search ..... 343/704, 713; H01Q 1/32, 1/02

(56) References Cited

U.S. PATENT DOCUMENTS 5,029,308 * 7/1991 Lindenmeier et al. ..... 343/704
5,581,263 * 12/1996 Maeda et al. ..... 343/704
5,581,264 * 12/1996 Tabata et al. ..... 343/704
5,801,663 * 9/1998 Lindenmeier et al. ..... 343/704

* cited by examiner

*Primary Examiner*—Michael C. Wimer
(74) *Attorney, Agent, or Firm*—Pennie & Edmonds LLP

(57) ABSTRACT

A window glass antenna apparatus for vehicles comprising a vertical center wire provided in the middle and horizontal direction of a defogger for defogging a window glass of a vehicle, and a pair of short stub conductors provided at positions a ¼ wavelength of a wave in the horizontal direction away from the vertical center wire, and grounded through their respective grounding capacitors at high frequencies.

20 Claims, 3 Drawing Sheets

WINDOW GLASS ANTENNA APPARATUS FOR VEHICLES

CROSS-REFERENCE TO RELATED APPLICATION

This application is based upon and claims the benefit of priority from the prior Japanese Patent Application No. 11-040133, filed Feb. 18, 1999, the entire contents of which are incorporated herein by reference.

BACKGROUND OF THE INVENTION

The present invention relates to a window glass antenna for vehicles which is mounted on a window glass of a vehicle such as an automobile.

A conventional vehicle window glass antenna is assembled by attaching an antenna element having a given pattern and constituted of narrow thin-film conductors on a rear window of an automobile.

Usually a defogger is attached to the rear window in order to defog a glass of the window. The defogger includes a plurality of horizontal wires constituted of narrow thin-film conductors which are arranged in parallel and at almost regular intervals on the rear window. First ends of the horizontal wires are connected together by one of paired bus bars, while second ends thereof are connected together by the other bus bar.

If a direct-current power supply voltage is applied to the bus bars from a car-mounted battery (12V), the horizontal wires generate heat to prevent the fogging of the window glass due to condensation.

The vehicle window glass antenna is provided between the uppermost portion of the defogger and the window frame. The narrow thin-film conductors are formed on the window glass in a given pattern such that the antenna can receive radio waves of a predetermined frequency, and used as antenna elements. A feeding point of the antenna elements is connected to a tuner of a receiver set through a feeder formed of a coaxial cable.

In most cases, a desired antenna characteristic cannot be obtained from the above conventional vehicle window glass antenna, since the surroundings of the antenna are varied with vehicle types and other conditions, even though the antenna itself is accurately assembled based on a fixed standard. The window glass is usually surrounded with a metallic car body; therefore, it is difficult to design the antenna only by the antenna theory. For this reason, the actual state is that the antenna characteristic such as an impedance is adjusted using a cut-and-try method. More specifically, when the antenna is mounted on the window glass, a characteristic measuring instrument, such as an impedance meter, is connected to an end portion of the feeder in place of the tuner, and the antenna characteristic is controlled by correcting the pattern, length or the like of the antenna using the cut-and-try method.

A technique of utilizing the defogger as an antenna element is also proposed. In this technique, too, the antenna characteristic has to be adjusted using the cut-and-try method in order to acquire a desired antenna characteristic.

As described above, in the conventional vehicle window glass antenna, the antenna characteristic had to be adjusted using the cut-and-try method according to the types of vehicles on which the antenna was to be mounted, in order to obtain a desired antenna characteristic. Furthermore, the conventional antenna had the problem that it was very difficult and took a long period of time to adjust a frequency band of use by the above cut-and-try method.

BRIEF SUMMARY OF THE INVENTION

An object of the present invention is to provide a window glass antenna apparatus for vehicles which is capable of quickly and accurately adjusting the setting of a desired characteristic.

According to one aspect of the present invention, there is provided a window glass antenna apparatus for vehicles, comprising a defogger attached to a window glass of a vehicle, for defogging the window glass, the defogger including a plurality of horizontal wires constituted of a plurality of thin, narrow conductors and arranged parallelly and horizontally at regular intervals, and a pair of bus bars for connecting both ends of the plurality of horizontal wires together, a power supply unit which supplies power to the defogger to heat the defogger, a separating coil which separates the power supply unit and the defogger from each other at high frequencies, a vertical center wire constituted of a thin, narrow conductor and crossing the horizontal wires in a middle portion of the defogger and in a horizontal direction thereof, a pair of short stub conductors constituted of thin, narrow conductors and provided at right and left positions a ¼ wavelength of a wave applicable to transmission/reception away from the vertical center wire so as to cross the horizontal wires of the defogger, and a pair of grounding capacitors which ground the pair of short stub conductors at high frequencies.

According to another aspect of the present invention, there is provided a window glass antenna apparatus for vehicles, comprising a defogger, attached to a window glass of a vehicle, which defogs the window glass, the defogger including a plurality of horizontal wires constituted of a plurality of thin, narrow conductors and arranged parallelly and horizontally at regular intervals, and bus bars for connecting both ends of the plurality of horizontal wires together, a power supply unit which supplies power to the defogger to heat the defogger, a separating coil for separating the power supply unit and the defogger from each other at high frequencies, and a vertical center wire constituted of a thin, narrow conductor and crossing the horizontal wires in a middle portion of the defogger and in a horizontal direction thereof, wherein the bus bars cross the horizontal wires of the defogger at right and left positions a ¼ wavelength of a wave applicable to transmission/reception away from the vertical center wire to serve as short stub conductors, and a pair of grounding capacitors is provided to ground the bus bars serving as the short stub conductors, at high frequencies.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
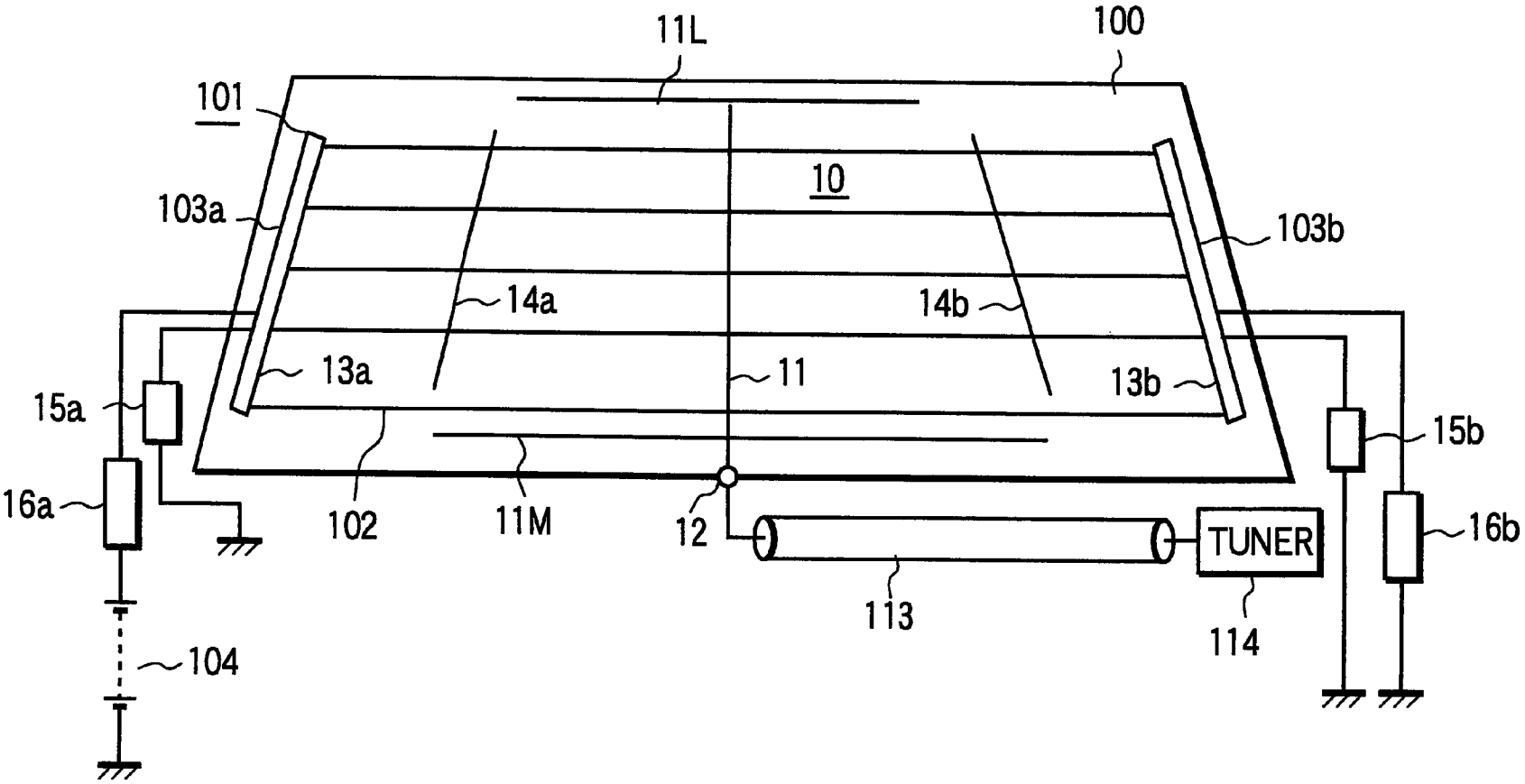
FIG. 1 is a view showing a constitution of an FM/AM wave receiving vehicle window glass antenna according to a first embodiment of the present invention.

FIG. 1 illustrates an FM/AM wave receiving vehicle window glass antenna 10 according to a first embodiment of the present invention. A defogger 101 is attached to a rear window 100 to defog a glass of the rear window 100. The defogger 101 includes a plurality of horizontal wires 102 constituted of thin, narrow conductors. The horizontal wires 102 are arranged in parallel at almost regular intervals on the rear window 100. The ends of the horizontal wires 102 are connected together by a bus bar 103*a*, while the other ends thereof are connected together by a bus bar 103*b*. If a direct-current power supply voltage is applied to the bus bars 103*a* and 103*b* from a car-mounted battery (12V) 104 through choke coils 16*a* and 16*b* serving as high-frequency separating coils (described later), the wires 102 generate heat by energization to prevent condensation from being caused on the window glass. Thus, the fogging of the rear window 100 due to condensation can be prevented.

The following antenna elements are added to the defogger 101, and the antenna 10 is formed so as to overlap the defogger 101.

First a vertical center wire 11, which is constituted of a thin, narrow conductor, is provided in the middle and horizontal direction of the defogger 101 so as to cross the horizontal wires 102 at right angles. A top loading conductor 11L, which is thin and narrow, is attached to the upper end portion of the vertical center wire 11. More specifically, the conductor 11L is arranged in parallel with the horizontal wires 102 and its middle portion is connected to the upper end portion of the wire 11. On the other hand, a frequency band matching adjusting conductor 11M, which is also thin and narrow, is attached to the vertical center wire 11 near the lower end portion thereof. The conductor 11M is arranged in parallel with the horizontal wires 102 and its middle portion is connected to the lower end portion of the wire 11. The lower end portion of the wire 11 serves as a feed point 12 and is connected to a tuner 114 of a reception set via a feeder 113 formed of a coaxial cable.

In the first embodiment, the bus bars 103*a* and 103*b* of the defogger 101 also serve as short stub conductors 13*a* and 13*b*, respectively. The short stub conductors 13*a* and 13*b* are provided at right and left positions λ/4 away from the vertical center wire 11 so as to cross the horizontal wires 102 of the defogger 101 (including the cases where they cross each other at right angles and somewhat diagonally) when the wavelength of a receiving wave (e.g., an FM receiving wave whose center frequency is about 100 MHz) is λ.

In the first embodiment, a distance between the bus bars 103*a* and 103*b* is set to about 1.5 m; accordingly, a distance from the vertical center wire 11 to each of the bus bars 103*a* and 103*b* is about 75 cm. The latter distance corresponds to λ/4 when the wavelength of a 100-MHz wave is λ. The bus bars 103*a* and 103*b* of the defogger 101 are therefore utilized as the short stub conductors 13*a* and 13*b*.

A short stub adjusting conductor 14*a*, which is thin and narrow, is provided between the vertical center wire 11 and one of the short stub conductors 13*a*, i.e., the bus bar 103*a* and in almost parallel with them, while a short stub adjusting conductor 14*b*, which is also thin and narrow, is provided between the wire 11 and the other short stub conductor 13*b*, i.e., the bus bar 103*b* and in almost parallel with them. These short stub adjusting conductors 14*a* and 14*b* are used for adjusting short stub functions of the short stub conductors 13*a* and 13*b*.

The short stub conductor 13*a*, or the bus bar 103*a* is grounded via a grounding capacitor 15*a*, as is the short stub conductor 13*b*, or the bus bar 103*b* via a grounding capacitor 15*b*.

The grounding capacitors 15*a* and 15*b* are aims at grounding the short stub conductors 13*a* and 13*b* at high frequencies. Therefore, capacitive elements which have a low impedance for FM waves and a high impedance for AM waves, are used as the grounding capacitors 15*a* and 15*b*.

The choke coils 16*a* and 16*b* separate a power supply path including the battery 104 from both ends of the defogger 101 at high frequencies to open both the ends of the defogger 101 at high frequencies. Thus, inductive elements having a considerable impedance for a frequency are used as the choke coils 16*a* and 16*b*.

Figure 2A:
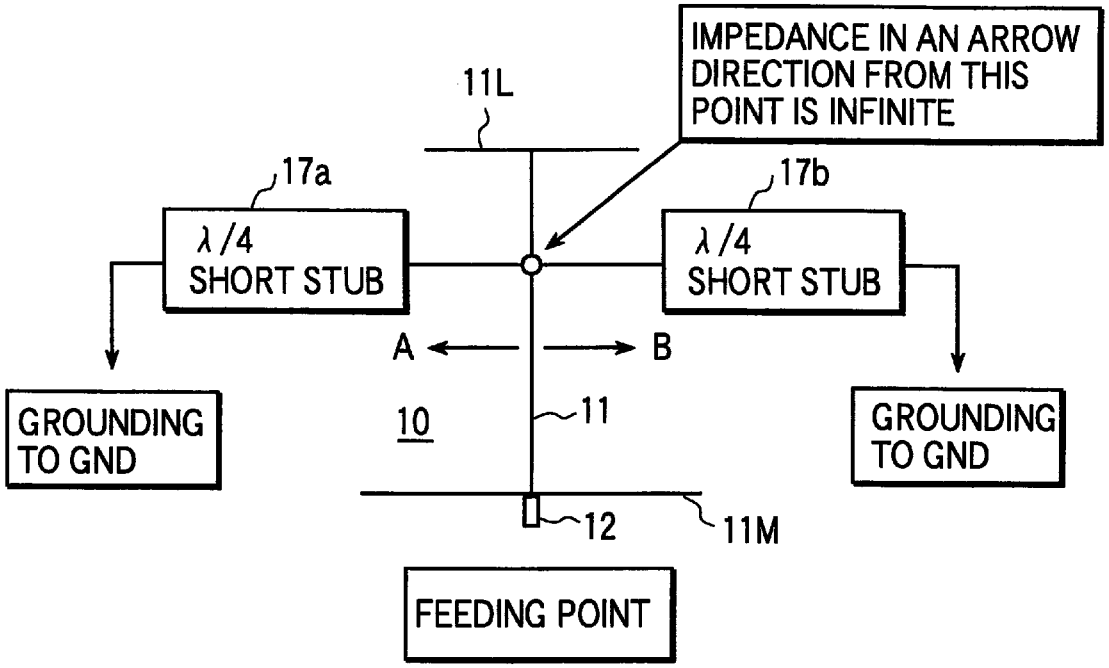
FIGS. 2A and 2B are views simply and equivalently showing the vehicle window glass antenna 10 of FIG. 1 in two stages.
Figure 2B:
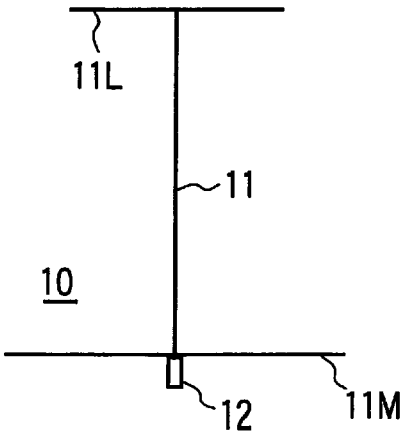

FIGS. 2A and 2B are views simply and equivalently showing the vehicle window glass antenna 10 of FIG. 1 in two stages. As described above, the vehicle window glass antenna 10 is so assembled that the vertical center wire 11 is provided in the middle portion of the defogger 101 so as to cross the horizontal wires 102 at right angles, and the bus bars 103*a* and 103*b* serving as the short stub conductors 13*a* and 13*b* are grounded at high frequencies via the grounding capacitors 15*a* and 15*b*, respectively.

Consequently, as illustrated in FIG. 2A, λ/4 short stubs 17*a* and 17*b* in the frequency band close to 100 MHz are formed on both sides of the vertical center wire 11. The impedances in the directions of arrows A and B from one point P of the vertical center wire 11 are almost infinite. Therefore, as shown in FIG. 2B, the elements of the defogger 101 can be ignored in substance, and only the vertical center wire 11 including both the top loading conductor 11L and frequency band matching adjusting conductor 11M is to function as an antenna element suitable for the frequency of FM/AM waves. Consequently, the antenna theory that only the vertical center wire 11, which is provided in the middle portion and horizontal direction of the defogger 101, is formed as a single antenna element, can be applied to the antenna apparatus of the present invention, with the result that the antenna characteristic can be adjusted simply, quickly and accurately, and the frequency band of use can be adjusted easily, whereas it was very difficult to use the conventional cut-and-try method to adjust the frequency band.

Figure 3:
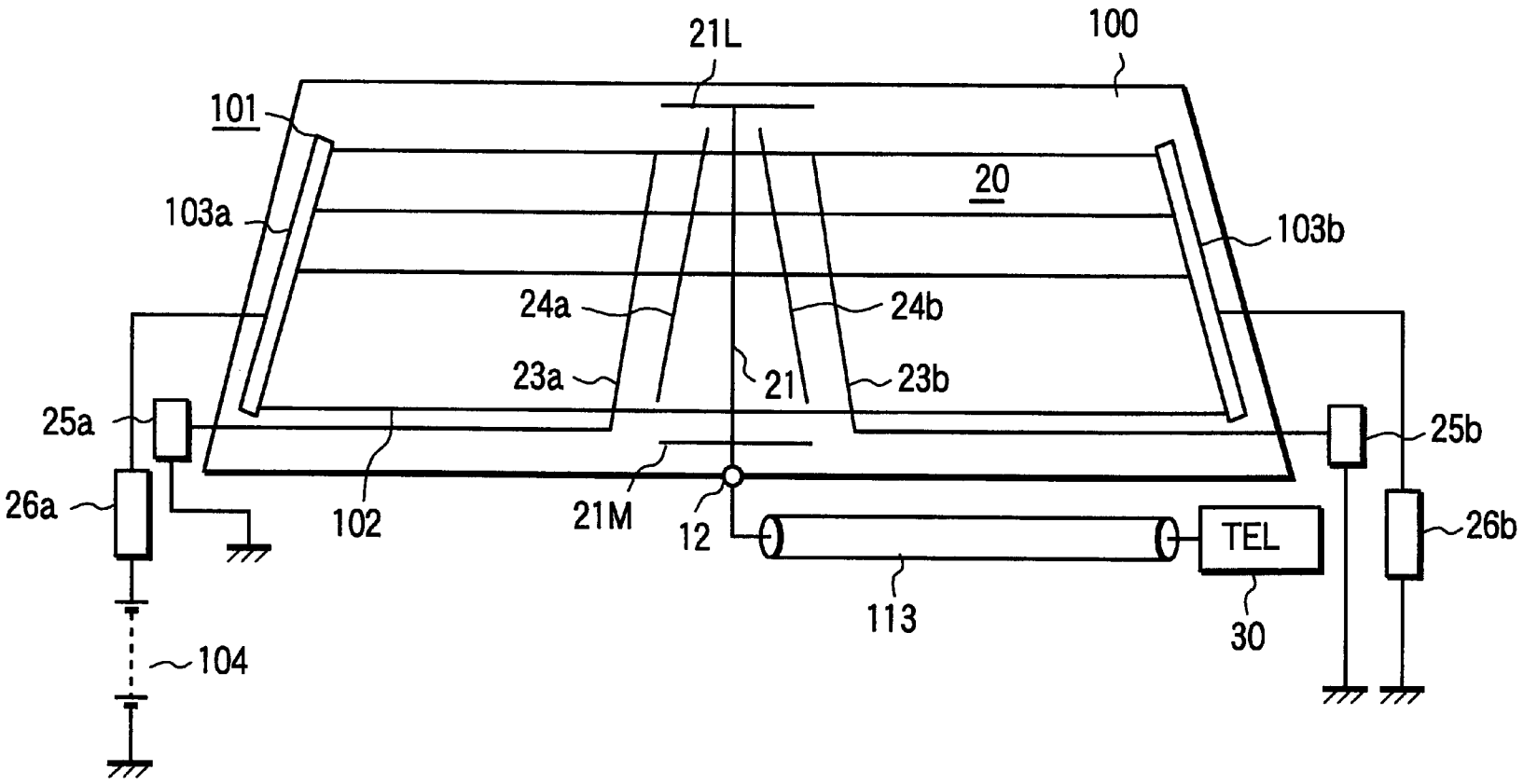
FIG. 3 is a view showing a constitution of an 800-MHz-band wave transmitting/receiving vehicle window glass antenna according to a second embodiment of the present invention.

FIG. 3 is a view of a constitution of an 800-MHz-band (which corresponds to a transmit/receive wave band for portable telephones) wave transmitting/receiving vehicle window glass antenna 20 according to a second embodiment of the present invention.

The vehicle window glass antenna 20 of the second embodiment differs from that of the first embodiment chiefly in the following three points.

Firstly, in order to form an 800-MHz-band λ/4 short stub, short stub conductors 23*a* and 23*b* are provided at positions 93.75 mm, which is λ/4 of 800-MHz transmit/receive waves, away from a vertical center wire 21 so as to cross horizontal wires 102, and these conductors are grounded at high frequencies through their respective grounding capacitors 25*a* and 25*b*.

Secondly, since a frequency band of use is 800 MHz, capacitive elements having a low impedance in the frequency band of 800 MHz are used as the grounding capacitors 25*a* and 25*b*, and inductive elements having a high impedance in the frequency band of 800 MHz are used as choke coils 26*a* and 26*b*.

Thirdly, instead of the tuner 114 of the reception set, a portable telephone 30 is connected to the antenna 20. As in the first embodiment, the antenna 20 is provided with a top loading conductor 21L, a frequency band matching adjusting conductor 21M, a feeding point 12, and short stub adjusting conductors 24*a* and 24*b*.

The vehicle window glass antenna of the above embodiments can be provided with a $\lambda/4$ short stub suitable for the wavelength of TV broadcasting waves such that it can receive the TV broadcasting waves.

The vehicle window glass antenna according to the present invention includes a vertical center wire in the middle portion and horizontal direction of a defogger for defogging a window glass. A pair of short stub conductors is located ¼ of the wavelength of a wave in the horizontal direction away from the vertical center wire, and grounded at high frequencies through grounding capacitors. Therefore, the general antenna theory that the vertical center wire is formed as a single antenna element, can be applied to the antenna of the present invention, with the result that a desired antenna characteristic can be adjusted and set quickly and accurately.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A window glass antenna apparatus for vehicles, comprising:

a defogger attached to a window glass of a vehicle, for defogging the window glass, the defogger including a plurality of horizontal wires constituted of a plurality of thin, narrow conductors and arranged parallelly and horizontally at predetermined intervals, and a pair of bus bars for connecting both ends of the plurality of horizontal wires together;

a power supply unit configured to supply power to the defogger to heat the defogger;

a separating coil configured to separate the power supply and the defogger from each other at high frequencies;

a vertical center wire constituted of a thin, narrow conductor and crossing the horizontal wires in a middle portion of the defogger and in a horizontal direction thereof;

a pair of short stub conductors constituted of thin, narrow conductors and provided at right and left positions a ¼ wavelength of a wave applicable to transmission/reception away from the vertical center wire so as to cross the horizontal wires of the defogger; and a pair of grounding capacitors configured to ground the pair of short stub conductors at high frequencies.

2. The apparatus according to claim 1, further comprising a pair of short stub adjusting conductors provided between the vertical center wire and the short stub conductors and configured to adjust respective short stub functions of the short stub conductors.

3. The apparatus according to claim 1, further comprising:

a top loading conductor connected to an upper end portion of the vertical center wire and provided in parallel with the horizontal wires; and a frequency band matching adjusting conductor connected to a lower end portion of the vertical center wire and provided in parallel with the horizontal wires near the lower end portion, the lower end portion of the vertical center wire being connected to a feeder.

4. The apparatus according to claim 3, further comprising at least one short stub adjusting conductors provided between the vertical center wire and the short stub conductors and configured to adjust respective short stub functions of the short stub conductors.

5. The apparatus according to claim 3, wherein the lower end portion of the vertical center wire is connected to a tuner included in a receiver.

6. The apparatus according to claim 3, wherein the lower end portion of the vertical center wire is connected to a portable telephone.

7. The apparatus according to claim 1, wherein the defogger is attached to a rear window glass of the vehicle.

8. The apparatus according to claim 1, wherein the plurality of horizontal wires are arranged at regular intervals.

9. The apparatus according to claim 1, wherein the power supply unit includes a battery serving as a direct-current power supply mounted on the vehicle.

10. A window glass antenna apparatus for vehicles, comprising:

a defogger attached to a window glass of a vehicle, for defogging the window glass, the defogger including a plurality of horizontal wires constituted of a plurality of thin, narrow conductors and arranged parallelly and horizontally at regular intervals, and bus bars for connecting both ends of the plurality of horizontal wires together;

a power supply unit configured to supply power to the defogger to heat the defogger;

a separating coil configured to separate the power supply unit and the defogger from each other at high frequencies; and a vertical center wire constituted of a thin, narrow conductor and crossing the horizontal wires in a middle portion of the defogger and in a horizontal direction thereof, wherein the bus bars cross the horizontal wires of the defogger at right and left positions a ¼ wavelength of a wave applicable to transmission/reception away from the vertical center wire to serve as short stub conductors, and a pair of grounding capacitors is provided to ground the bus bars serving as the short stub conductors, at high frequencies.

11. The apparatus according to claim 10, further comprising at least one short stub adjusting conductors provided between the vertical center wire and the bus bars and configured to adjust respective short stub functions.

12. The apparatus according to claim 10, further comprising:

a top loading conductor connected to an upper end portion of the vertical center wire and provided in parallel with the horizontal wires; and a frequency band matching adjusting conductor connected to a lower end portion of the vertical center wire and provided in parallel with the horizontal wires near the lower end portion.

13. The apparatus according to claim 12, wherein the lower end portion of the vertical center wire is connected to a tuner included in a receiver.

14. The apparatus according to claim 12, wherein the lower end portion of the vertical center wire is connected to a portable telephone.

15. The apparatus according to claim 10, further comprising at least one short stub adjusting conductors provided between the vertical center wire and the bus bars, for adjusting respective short stub functions.

16. The apparatus according to claim 10, wherein the defogger is attached to a rear window glass of the vehicle.

17. The apparatus according to claim 10, wherein the plurality of horizontal wires are arranged at regular intervals.

18. The apparatus according to claim 10, wherein the power supply unit includes a battery serving as a direct-current power supply mounted on the vehicle.

19. A window glass antenna apparatus for vehicles, comprising:

a defogger attached to a window glass of a vehicle and heated by feeding to defog the window glass, the defogger including a plurality of horizontal wires constituted of a plurality of thin, narrow conductors and arranged parallelly and horizontally at predetermined intervals, and a pair of bus bars for connecting both ends of the plurality of horizontal wires together;

a vertical center wire constituted of a thin, narrow conductor and crossing the horizontal wires in a middle portion of the defogger and in a horizontal direction thereof; and a pair of short stub conductors constituted of thin, narrow conductors and provided at right and left positions a ¼ wavelength of a wave applicable to transmission/reception away from the vertical center wire so as to cross the horizontal wires of the defogger.

20. A window glass antenna apparatus for vehicles, comprising:

a defogger attached to a window glass of a vehicle and heated by feeding to defog the window glass, the defogger including a plurality of horizontal wires constituted of a plurality of thin, narrow conductors and arranged parallelly and horizontally at predetermined intervals, and bus bars for connecting both ends of the plurality of horizontal wires together; and a vertical center wire constituted of a thin, narrow conductor and crossing the horizontal wires in a middle portion of the defogger and in a horizontal direction thereof, wherein the bus bars cross the horizontal wires of the defogger at right and left positions a ¼ wavelength of a wave applicable to transmission/reception away from the vertical center wire to serve as short stub conductors.

* * * * *